US005995356A

United States Patent [19]

Glavmo et al.

[11] Patent Number: 5,995,356

[45] Date of Patent: Nov. 30, 1999

[54] METHOD AND APPARATUS FOR CONTROLLING AND DETECTING THE POSITION OF A SOLENOID-OPERATED VALVE ELEMENT

[75] Inventors: Magnus Glavmo; Magnus Larsson, both of Åmål; Bo Neidenström; Sven-Anders Melin, both of Södertälje, all of Sweden

[73] Assignee: Scania CV Aktiebolag, Sweden

[21] Appl. No.: 08/983,053

[22] PCT Filed: Jul. 9, 1996

[86] PCT No.: PCT/SE96/00927

§ 371 Date: Jan. 15, 1998

§ 102(e) Date: Jan. 15, 1998

[87] PCT Pub. No.: WO97/04230

PCT Pub. Date: Feb. 6, 1997

[30] Foreign Application Priority Data

Jul. 17, 1995 [SE] Sweden ..... 9502622

[51] Int. Cl.[6] ..... H01F 17/18

[52] U.S. Cl. ..... 361/154; 361/160; 361/190

[58] Field of Search ..... 361/152–156, 361/159, 160, 170, 189, 190; 251/129.01, 129.15; 123/472, 490

[56] References Cited

U.S. PATENT DOCUMENTS 4,856,482 8/1989 Linder et al. ..... 123/506
5,053,911 10/1991 Kopec et al. ..... 361/154
5,245,501 9/1993 Locher et al. ..... 361/154
5,717,562 2/1998 Antone et al. ..... 361/155
5,825,216 10/1998 Archer et al. ..... 123/490

FOREIGN PATENT DOCUMENTS 9413991 6/1994 WIPO .

*Primary Examiner*—Fritz Fleming
*Attorney, Agent, or Firm*—Ostrolenk, Faber, Gerb & Soffen, LLP

[57] ABSTRACT

A method and apparatus for controlling a solenoid-operated valve element are provided. The valve element is movable between first and second end positions, and is urgable toward the first end position by magnetic attraction caused by activation of the solenoid and is normally urged toward the second end position. The method further enables detection of the time at which the valve element returns to the second end position from the first end position after deactivation of the solenoid. The method includes activating the solenoid by sending current from a current source through the solenoid to urge the valve element to the first end position, deactivating the solenoid by disconnecting the solenoid from the current source so that the valve element is urged toward the second end position, reconnecting the second end of the solenoid to the second pole of the current source a predetermined time after the solenoid is deactivated such that remaining energy in the solenoid generates a measuring current, and measuring the measuring current to detect a first predetermined characteristic change in the measuring current which occurs when the valve element has returned to the second end position.

26 Claims, 5 Drawing Sheets

FIG. 2c
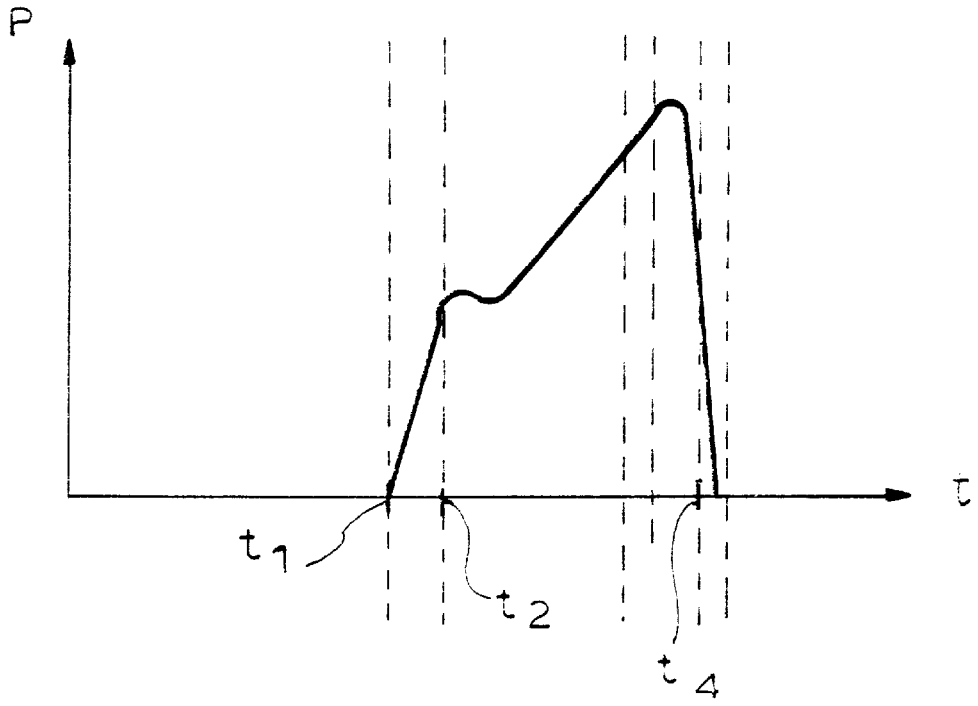
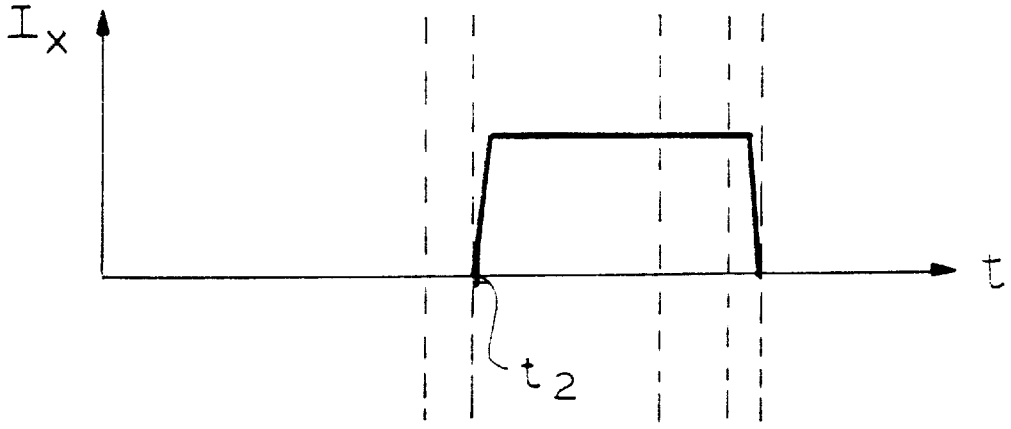
FIG. 2d

METHOD AND APPARATUS FOR CONTROLLING AND DETECTING THE POSITION OF A SOLENOID-OPERATED VALVE ELEMENT

The invention relates to a method for controlling a solenoid-operated valve element and detecting the position of the valve element, and an arrangement which makes it possible to use the method.

BACKGROUND

SAE Technical Paper 850542 "DDEC Detroit Diesel Electronic Control" describes in detail a method for detecting when a solenoid-operated movable valve element reaches an end position. Injection commences when a closed position is reached. The method is based on studying the flow through, or the voltage across, the solenoid, which flow or voltage undergoes a change when the valve element changes from being in motion to being stationary in an end position. The reaching of the end position is defined as the time when the first-order time derivative of the current (dI/dt) or voltage (dU/dt) passes through zero. The zero crossing is caused by a sudden change in inductance when the valve element becomes stationary in its end position.

U.S. Pat. No. 5,182,517 refers to a more developed variant whereby both the closing and the opening of the control valve, i.e. in this case the commencement and cessation of fuel injection in a combustion engine, are detected by analysing the current through the solenoid. The opening of the control valve, i.e. the interruption of injection, is detected by the fact that a free-wheel circuit opens. Free-wheeling means that the current is led into a circuit with a certain resistance so that the energy which is stored in the solenoid in the form of its magnetic field is reduced. When the current is free-wheeled, this value decreases exponentially and the time when the control valve reaches the fully open position is defined as the time when the value of the current has a local maximum value, i.e. the derivative of the current passes through zero. This method is used for measuring the start and length of an injection cycle for the purpose of controlling the fuel quantity injected and the time when the injection takes place. A disadvantage of the free-wheeling method is that the ill-defined phases when the control valve is set in motion from one end position to the other, particularly when the control valve is opening, are unnecessarily long. This is a disadvantage with regard to exact determination of the fuel quantity injected.

DE 4222650 refers to a variant whereby free-wheeling can be limited on the basis of the engine speed at the time. At low speeds, full free-wheeling is permitted but with successively increasing speed the free-wheeling period is shortened until in the higher speed range it is completely eliminated. This solution is used in order to limit noise from the control valve at low engine speeds, at which the result is a slower control valve movement, with a more rapid control valve movement at higher speeds and consequently more precise determination of the fuel quantity injected. The predominance of other noise sources at these higher speeds then makes it less necessary to limit noise from the control valve.

The documents mentioned above refer to solutions which are applied to fuel injectors for combustion engines whereby the fuel pressure builds up when a solenoid-operated control valve is closed, followed by the injection valve opening when the pressure in the fuel reaches a given level, of the order of a couple of hundred bars. In these arrangements the time when injection takes place is calculated by detecting the time when the control valve closes and adding a time which in principle is constant but depends to some extent on the type of injector and certain conditions such as temperature. This time corresponds to the time during which the fuel pressure against the injection valve builds up. In this case the fuel quantity injected can be detected by also detecting the time when the control valve opens, since the fuel pressure then begins to drop, and the injection valve closes when the pressure drops to a predetermined level.

During the period when the control valve is moving towards the open position, the flow through the control valve is not well defined, thereby unpredictably influencing the closure of the injection valve. The determination of the fuel quantity injected thus becomes relatively uncertain, thereby worsening the possibility of exactly controlling the fuel quantity injected with a view to its corresponding to the desired power output from the engine and at the same time to achieving optimum control of fuel consumption and emissions.

To make the determination of the fuel quantity injected more precise and improve the possibility of controlling the fuel quantity injected during the injection period, it is important that the control valve be adjusted as quickly as possible and that the reaching of both of its end positions can be precisely detected in order to determine the fuel quantity injected.

U.S. Pat. No. 4,856,482 refers to a solution whereby the current through an electromagnetic valve is interrupted for a certain time in order to quickly urge the valve towards the other end position. After a certain time a second lower voltage level is applied to create a measuring current which can then be analysed in order to detect when the end position is reached. However, this solution does involve a relatively complicated circuit solution, since two voltage levels are applied.

OBJECTS OF THE INVENTION

The invention has the object of making possible a quicker movement of the valve element from a first end position at which the solenoid is activated to a second end position at which the solenoid is deactivated, while at the same time the reaching of the second end position can be detected by analysing the current through the solenoid without having to resort to an excessively complicated circuit solution.

Another object is to make it possible in a relatively simple and reliable manner, preferably on directly injected diesel engines, to determine more precisely the fuel quantity injected via a control valve controlling the injection.

BRIEF DESCRIPTION OF THE INVENTION

In accordance with the invention, a method and apparatus for controlling a solenoid-operated valve element are provided. The valve element is movable between first and second end positions, and is urgable toward the first end position by magnetic attraction caused by activation of the solenoid and is normally urged toward the second end position. The method further enables detection of the time at which the valve element returns to the second end position from the first end position after deactivation of the solenoid. The method includes activating the solenoid by sending current from a current source through the solenoid to urge the valve element to the first end position, deactivating the solenoid by disconnecting the solenoid from the current source so that the valve element is urged toward the second end position, reconnecting the second end of the solenoid to the second pole of the current source a predetermined time after the solenoid is deactivated such that remaining energy in the solenoid generates a measuring current, and measuring the measuring current to detect a first predetermined characteristic change in the measuring current which occurs when the valve element has returned to the second end position. By first interrupting the current to the solenoid acting on the control valve it is possible to achieve in the injection system of combustion engines a rapid opening of the valve which influences the duration of the injection. At the same time it is easy to detect when the control valve reaches an end position, corresponding to its being fully open, by using the remaining energy in the solenoid to create a measuring current which is analysed in order to detect when the valve reaches the end position.

The apparatus of the invention provides a simple circuit solution incorporating a single external voltage level which makes it possible to use the method according to the invention.

Other features and advantages distinguishing the invention are indicated in the characterising parts of the other patent claims and in the description below of an embodiment with reference to the attached drawings.

BRIEF DESCRIPTION OF THE DRAWINGS

FIGS. 2*a–d* illustrate various states of a fuel injector for combustion engines where:

FIG. 2*a* shows the current through the solenoid as a function of time,

FIG. 2*b* shows the position of the control valve as a function of time,

FIG. 2*c* shows the fuel pressure against an injection valve as a function of time, and FIG. 2*d* shows the opening movement of the injection valve as a function of time.

DETAILED DESCRIPTION OF PREFERRED EMBODIMENT

Figure 1:
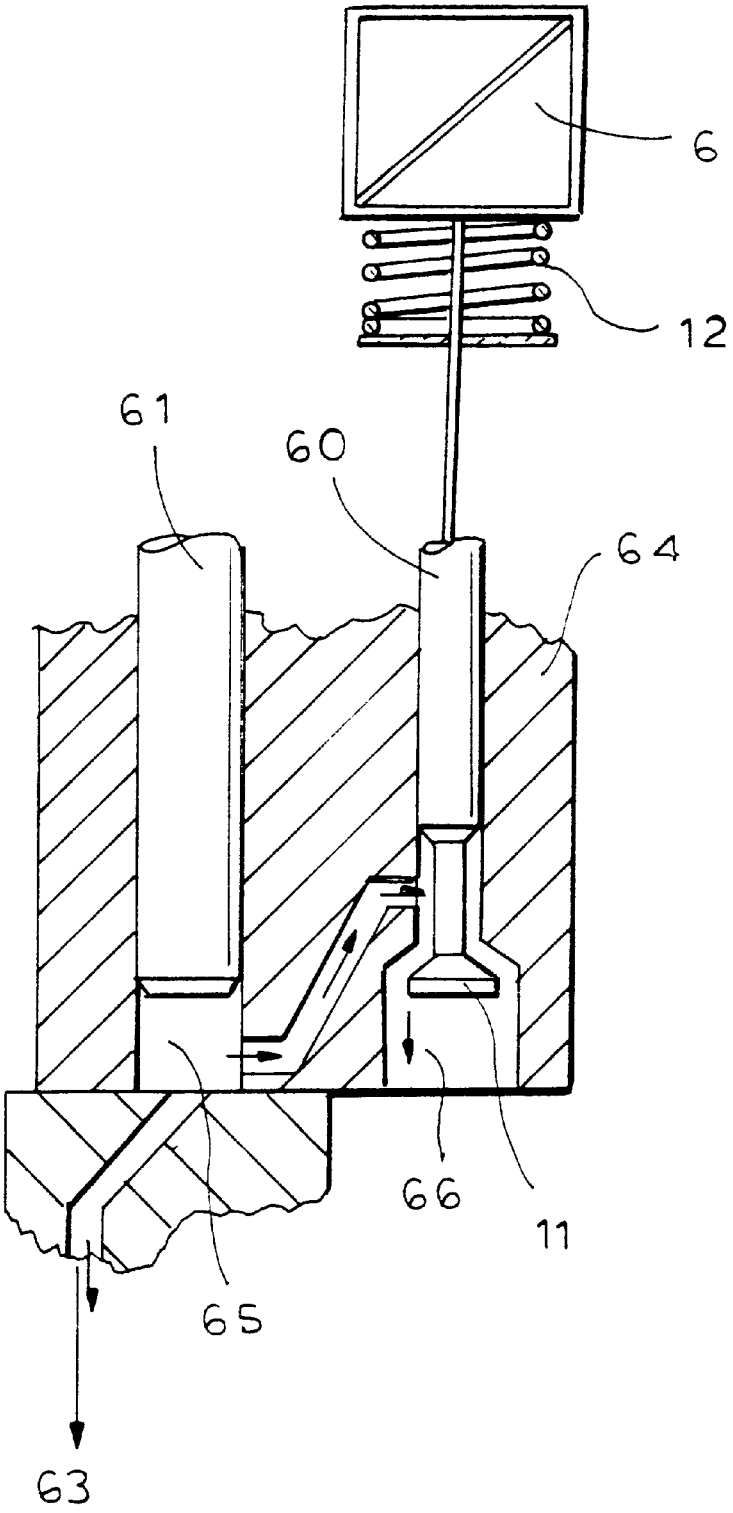
FIG. 1 shows a dosing arrangement forming part of a fuel injection system for combustion engines, in which a control valve is operated by a solenoid.

The invention is applied advantageously in electromechanically controlled fuel injection systems for combustion engines, preferably directly injected diesel engines for heavy vehicles. The fuel injector in such systems is of a conventional electromechanical type whereby the injection timing is controlled electrically and the injection pressure is built up mechanically by a pump element in the fuel injector which is operated via the camshaft. FIG. 1 shows the conventional fuel injector dosing arrangement incorporating a housing 64, a pump element 61 in the form of a plunger 61, a volume 65 below the plunger, a duct 63 to the injection valve, which takes the form of a spring-loaded needle valve (not illustrated), a return and filling duct 66 and a control valve 60 which is operated by a solenoid 6. The control valve 60 has a valve plug 11 which in the initial position is urged away from the valve seat by a spring 12. The valve element of the solenoid takes the form in this case of the control valve 60.

The conventional function of the dosing arrangement is described with reference to FIGS. 1 and 2*a–d* in which the dotted lines are intended to facilitate comparisons between the diagrams.

Figure 2A:
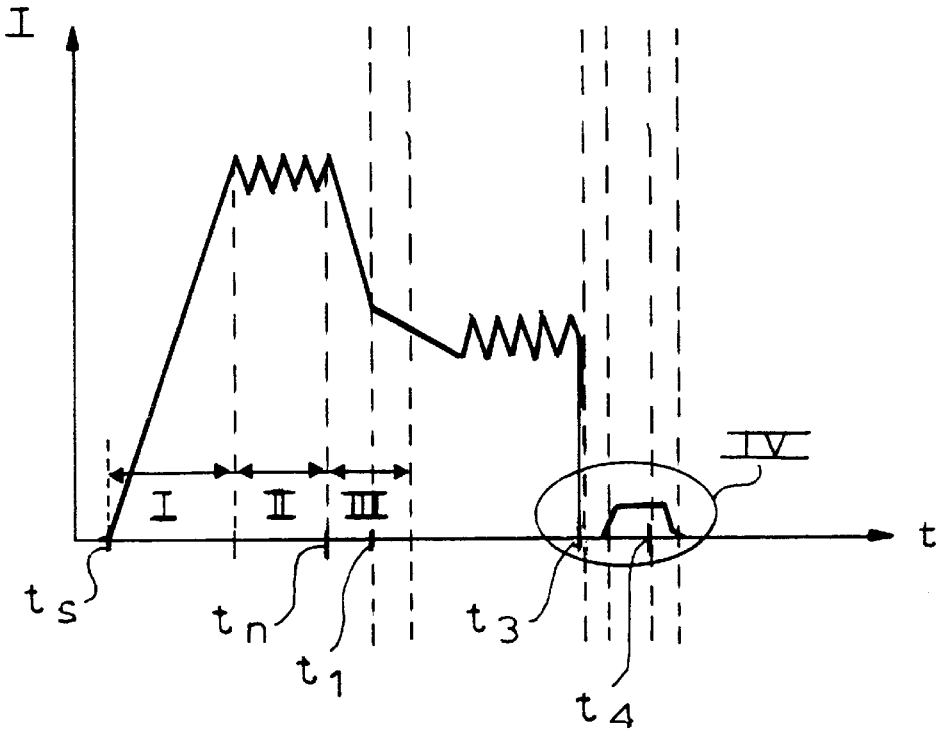
Figure 2B:
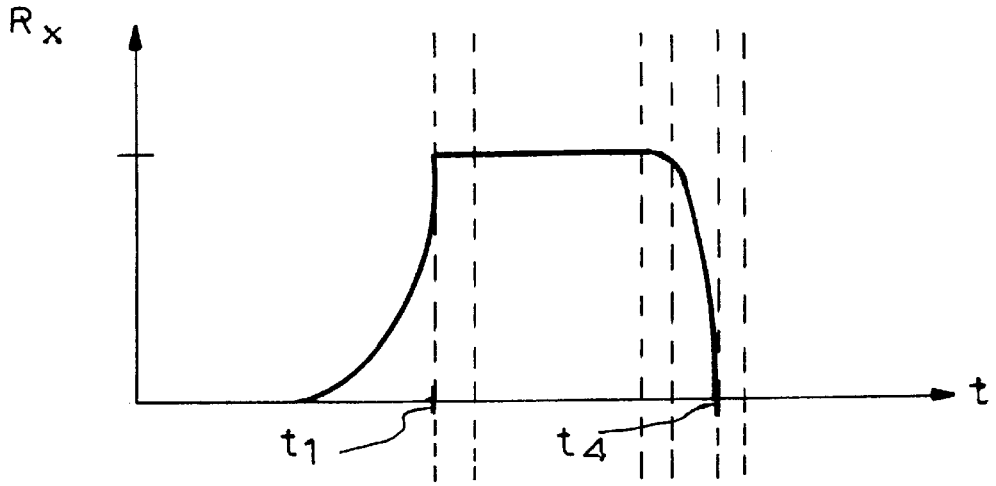

In the initial position, the control valve 60 is open and keeps the volume 65 below the plunger 61 filled with fuel. A camshaft cam (not illustrated) urges the plunger downwards so that the fuel moves past the control valve 60 and out through the return duct 66. When injection is to be actuated, a current is led through the solenoid 6, starting from the time t (see FIG. 2*a,* phase I). This creates a magnetic field in the solenoid. When the magnetic field reaches sufficient strength, the solenoid starts drawing the control valve upwards. FIG. 2*b* shows the control valve position Rx as a function of time t. When the current through the solenoid reaches a certain level, this starts a current control (phase II) which in this case takes place at a high-current level. When the current control has proceeded for a predetermined time, the solenoid is disconnected from the voltage supply and the current is allowed to free-wheel in a free-wheel circuit (described in more detail below) during phase III. When the strength of the current has decreased to a predetermined lower level, a current control starts at this low-current level.

The high-current level is selected so that a strong magnetic field is formed quickly in order to set the control valve in motion, whereas the current at the low-current level has only to create a magnetic field which is sufficiently strong to make the valve element remain in the end position.

The control valve reaches the end position at time $t_1$, which can be detected by the presence of a characteristic change of direction of the current curve during phase III. In the end position the return duct 66 is blocked so that the fuel in the volume 65 begins to be compressed, thereby increasing the pressure (see FIG. 2*c*). The duct 63 leads the fuel to the injection valve, which opens automatically at a certain pressure. The pressure rises in the volume 65 and the duct 63 until the injection valve opens, which takes place at time $t_2$ in FIG. 2*c*. In a directly injected diesel engine the injection valve opens at approximately 300 bars. FIG. 2*d* shows the injection valve opening movement $I_x$ as a function of time t.

When fuel injection has to be interrupted, this takes place in principle in the reverse order. The control system switches off the current control at the low-current level at time $t_3$ in FIG. 2*a*.

Figure 3:
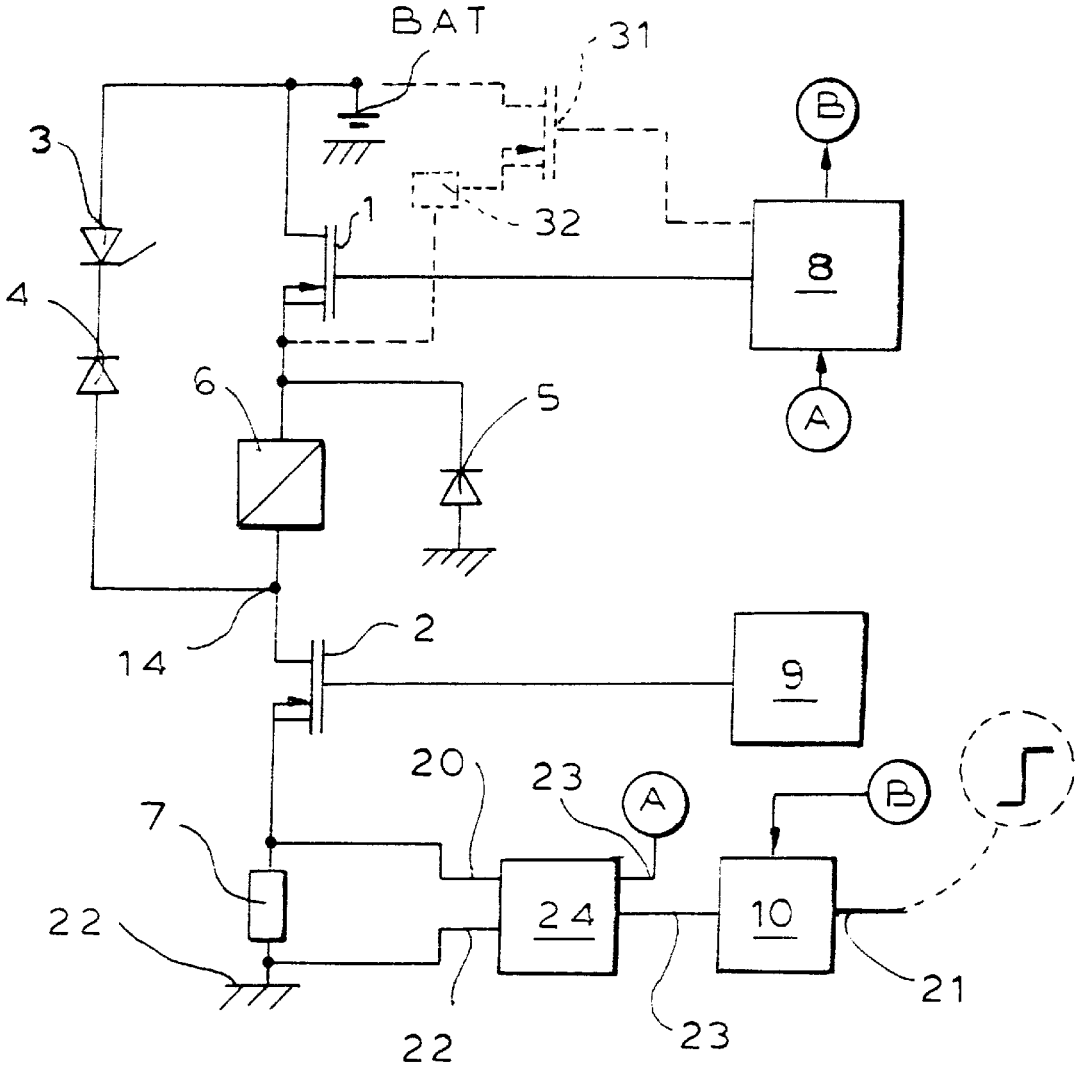
FIG. 3 shows a circuit solution for activating a solenoid and detecting the current through the solenoid.

FIG. 3 shows a circuit solution for driving a solenoid 6 to act on the valve element. One end of the solenoid 6 is connected to a battery BAT via a current-controlling breaker 1 and its other end is connected to earth via a second circuit-breaker 2 and a measuring point 7, which here takes the form of measuring resistor. In systems with two or more solenoids it is preferable to use only a single current-controlling breaker 1, whereby each solenoid can be activated by a respective activating breaker 2.

When the solenoid has to be activated, the breakers 1 and 2 are switched to a conducting state by a current control unit 8 and an activating unit 9 respectively. The current then begins to increase during phase I (see FIG. 2*a*) until it reaches a level at which current control begins in phase II. After a predetermined time the breaker 1 switches to a non-conducting state and a free-wheeling of current through the solenoid takes place during phase III. The free-wheel circuit is a closed circuit consisting of the solenoid 6, the breaker 2, the measuring resistor 7, the earth, a first current-directing device 5 in the form of a diode and back to the solenoid.

In parallel with the solenoid coil 6 between the battery BAT and the earth, second and third current-directing devices in the form of a back diode 4 and a zener diode 3 respectively are arranged in series. When the current through the solenoid is interrupted at time $t_3$ by switching of the breakers 1,2 to a non-conducting state, the voltage at the point 14 would risk increasing in the absence of the zener diode 3, which has a suitable breakdown voltage at which the energy in the coil can be discharged and fed back to the battery BAT. The zener diode 3 thus protects the breaker 2 against excessively high voltages, while the back diode 4 prevents the battery BAT from discharging to earth by the solenoid 6 being shunted.

The current through the solenoid is monitored by means of a measuring circuit 24 which measures the voltage across the measuring resistor 7 and delivers a signal (which corresponds to the current) via the lines 23,23' to a detection circuit 10 according to the invention and the current control unit 8 respectively (signal A in FIG. 3). The current control unit 8 can thus control the current so that the desired level is obtained.

The detection circuit 10 incorporates a measuring circuit for detecting the reaching of end positions, e.g. in the manner indicated in SAE Technical Paper 850542 or in U.S. Pat. No. 5,182,517, and is activated in a measuring window which is controlled by the current control unit 8 via the signal B.

According to the method according to the invention the deactivation of the solenoid is controlled as follows:

At time $t_3$ (see FIGS. 2*a* and 4) the circuit-breakers 1,2 are switched to a non-conducting state resulting in cessation of the current through the measuring resistor 7. The energy stored in the solenoid then drives the voltage at the point 14 to such a high level that the breakdown element, the zener diode 3, opens and leads the current back to the battery BAT. The energy in the solenoid is then discharged quickly and fed back to the battery. The strength of the magnetic field in the solenoid decreases correspondingly. After a predetermined time the circuit-breaker 2 reverts to a conducting state at time tF. This first predetermined time $t_3$—$t_F$ for which the circuit-breaker 2 is maintained in a non-conducting state depends inter alia on the inductance of the solenoid and is of the order of 50–200 ms (milliseconds) for a control valve for fuel injectors in directly injected diesel engines.

Figure 4:
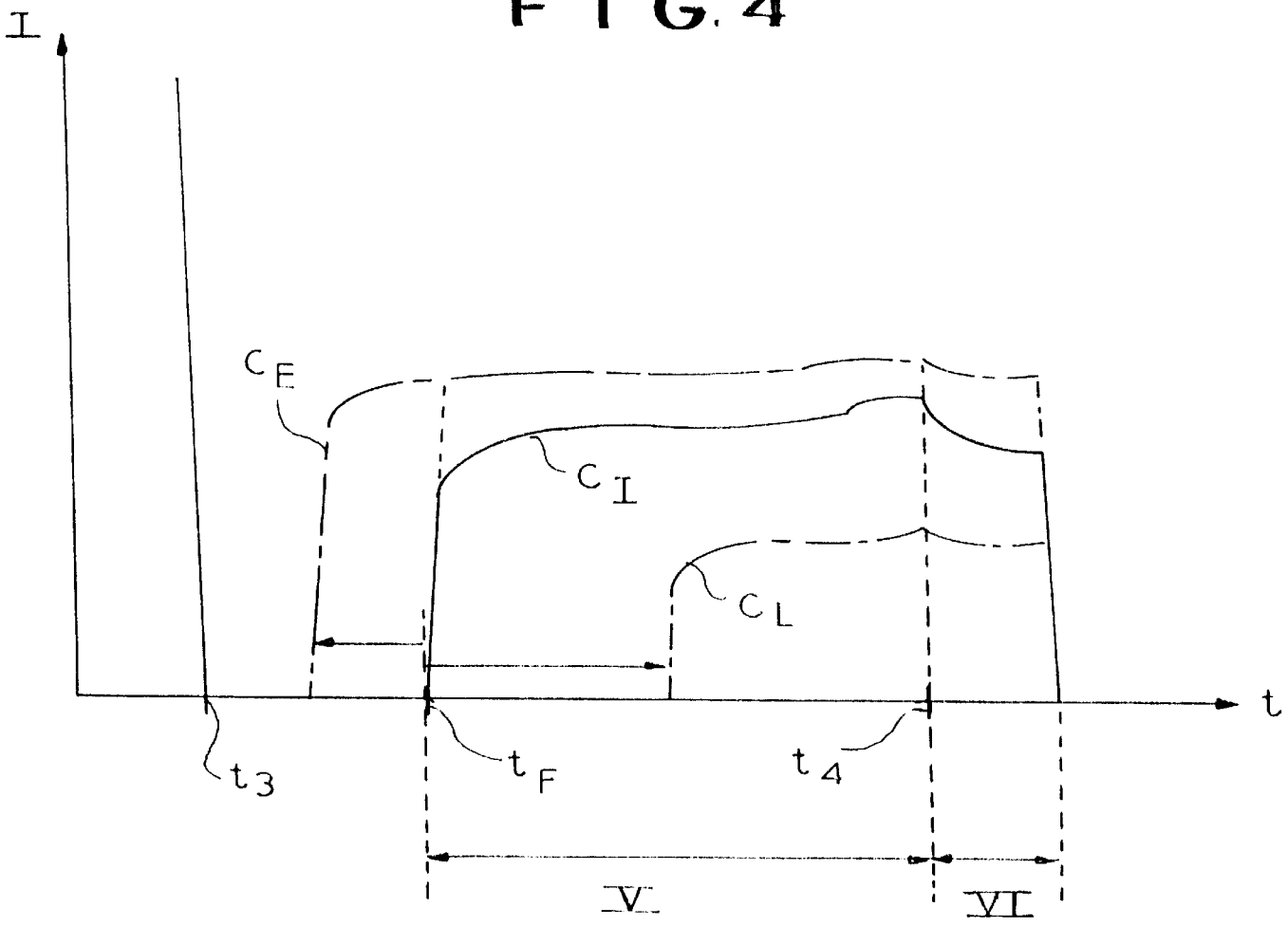
FIG. 4 shows on a larger scale the current through the solenoid as a function of time in the region marked IV in FIG. 2*a*.

In FIG. 4 the unbroken curve C, represents the current which is detected via the measuring resistor 7 from the time $t_F$ at which the circuit-breaker 2 is switched to a conducting state. At that time there remains in the solenoid a certain energy which is sufficient for driving a certain current through the measuring resistor 7. This current can be detected by the detection circuit 10 in any known manner, and when the current undergoes a predetermined characteristic change when the control valve reaches the other end position (i.e. the control valve is fully open at time $t_4$) it is established that the end position has been reached. In this case the characteristic change takes the form of a knee-like rise in the current curve as a result of the change in the inductance of the solenoid when the valve reaches its end position.

The chain-dotted curve $C_E$ shows how a higher current through the measuring resistor 7 is obtained if the second circuit-breaker 2 is switched to a conducting state somewhat earlier. This is because more energy is then stored in the solenoid, resulting in a higher current level. If the second circuit-breaker 2 is switched too early, experiments have shown that the characteristic knee on the current curve at time t4 is smoothed out and becomes more difficult to detect.

The chain-dotted curve $C_L$ shows how a lower current through the measuring resistor 7 is obtained if the second circuit-breaker 2 is switched to a conducting state somewhat later. This is because of less stored energy, resulting in a lower current level. It is also seen in this case that the characteristic knee on the current curve at time t4 is smoothed out. The first predetermined time for which the circuit-breaker 2 is maintained in a non-conducting state has therefore to be adapted for each type of solenoid on the basis of the latter's inductance so that the characteristic knee on the current curve is sufficiently detectable by the detection circuit 10.

This first time is also limited by the mechanical and dynamic properties of the solenoid. Reliable detection of the valve reaching an end position requires the circuit-breaker being switched with a margin to a conducting state so that the end position is reached after the second circuit-breaker 2 has been switched to a conducting state.

When reaching of the end position is detected, the circuit-breaker 2 is switched to a non-conducting state as quickly as possible in order to limit the time (V+VI) for which the measuring current is activated. This can take place as soon as the reaching of the end position is reliably detected. The time V+VI constitutes the measuring window during which the detection circuit 10 has to be kept activated, preferably by the current control unit 8 via the signal B. The time V+VI may be a fixed second predetermined time, preferably of the order of 200–600 ms for a control valve for fuel injectors in directly injected diesel engines, at which time the second circuit-breaker 2 is maintained in a conducting state.

The invention is not limited to an application in fuel injection systems and may within the scope of the patent claims be used in other applications which not only require that a solenoid-operated valve element should have a rapid valve element movement, but also require detection of the valve element reaching an end position.

The invention is likewise not limited to a solenoid deactivation procedure whereby the current through the solenoid is detected by means of a measuring resistor arranged between the solenoid and the earth. The detection of the current through the solenoid may of course also be by means of an inductive sensor arranged on or around the connecting lines of the solenoid, either in the earth connection of the solenoid or in the connection of the solenoid to the positive pole of the battery. The statement in the claims that the connection of the solenoid via the poles of the current source is interrupted refers to an interruption of the normal current circuit which is kept open while the solenoid is activated.

We claim:

1. A method for controlling a solenoid-operated valve element, the valve element being movable between first and second end positions, the valve element being urgable toward the first end position by magnetic attraction caused by activation of the solenoid and being normally urged toward the second end position, and the method being further for detecting the time at which the valve element returns to the second end position from the first end position after deactivation of the solenoid, the method comprising the steps of:

activating the solenoid by connecting a first end of the solenoid to a first pole of a current source and connecting a second end of the solenoid to a second pole of the current source for sending current from the current source through the solenoid for urging the valve element to the first end position;

deactivating the solenoid by disconnecting the solenoid from the poles of the current source for permitting the valve element to be urged toward the second end position;

reconnecting the second end of the solenoid to the second pole of the current source a first predetermined time after the solenoid is deactivated such that remaining energy in the solenoid generates a measuring current; and measuring the measuring current to detect a first predetermined characteristic change in the measuring current which occurs when the valve element has returned to the second end position.

2. The method of claim 1, wherein the second pole of the current source is a ground.

3. The method of claim 1, wherein the solenoid is disconnected by disconnecting both of the first and the second ends of the solenoid from the current source.

4. The method of claim 3, wherein the current source is a battery.

5. The method of claim 3, wherein the solenoid is normally urged toward the second end position by an actuating device.

6. The method of claim 5, wherein the actuating device is a spring.

7. The method of claim 3, wherein the first predetermined time is about 50 ms–200 ms.

8. The method of claim 3, wherein the second end of the solenoid is reconnected to the second pole of the current source during the reconnecting step for a second predetermined time during which the measuring step is performed, the method further comprising disconnecting the second end of the solenoid from the second pole of the current source after the second predetermined time.

9. The method of claim 8, wherein the second predetermined time is about 200 ms–600 ms.

10. The method of claim 3, further comprising leading the energy remaining in the solenoid after the activating step back to the current source by connecting the second end of the solenoid to the first pole of the current source through a voltage limiting circuit, and by connecting the first end of the solenoid to the second pole of the current source through a current limiting device, whereby the voltage limiting circuit and current limiting device prevent the formation of a closed current-carrying circuit which does not include the solenoid.

11. The method of claim 10, wherein the voltage limiting circuit includes a zener diode and a back diode, and wherein the current limiting circuit includes a diode.

12. The method of claim 3, further comprising measuring the measuring current during the measuring step at a measuring point between the second end of the solenoid and the second pole of the current source.

13. The method of claim 3, wherein the first predetermined characteristic change is a knee-like rise in the measuring current over time.

14. The method of claim 3, wherein the valve element forms part of a valve for controlling fuel injection under high pressure in a directly injected diesel engine.

15. The method of claim 3, further comprising the step of measuring the current in the solenoid during the first predetermined time to detect a second predetermined characteristic change in the current, the time at which the second predetermined characteristic change occurs being the time at which the valve element has reached the first end position.

16. The method of claim 15, wherein the valve element is a control valve for a diesel engine fuel injector, the first end position is a closed position of the valve and the second end position is an open position of the valve, and wherein the time at which the control valve reaches the closed position or the open position is used for defining the beginning and end respectively of the fuel injection period.

17. A solenoid-operated valve element, the solenoid being connectable to a current source having a first pole and a second pole, the valve element comprising:

a solenoid having a first end selectively connectable to the first pole of the current source and having a second end selectively connectable to the second pole of the current source, the solenoid being activated when the first and second ends are connected to the current source and deactivated when the first and second ends are disconnected from the current source;

a first circuit breaker between the first end of the solenoid and the first pole of the current source;

a second circuit breaker between the second end of the solenoid and the second pole of the current source;

a valve element movable between first and second end positions, the valve element being urgable toward the first end position by magnetic attraction caused by activation of the solenoid and being normally urged toward the second end position, wherein a measuring current is generated by activating the solenoid for urging the valve element to the first end position, then deactivating the solenoid for urging the valve element toward the second end position, and then reconnecting the second end of the solenoid to the second pole of the current source at a first predetermined time after the solenoid is deactivated, so that remaining energy in the solenoid generates the measuring current; and a current measuring unit for measuring the measuring current through the solenoid for determining when a predetermined characteristic change occurs in the measuring current as an indication of when the valve element has returned to the second end position.

18. The solenoid-operated valve element of claim 17, wherein the second pole of the current source is a ground.

19. The solenoid-operated valve element of claim 17, wherein the current source is a battery.

20. The solenoid-operated valve element of claim 17, further comprising an actuating device for urging the valve element toward the second end position.

21. The solenoid-operated valve element of claim 20, wherein the actuating device is a spring.

22. The solenoid-operated valve element of claim 17, further comprising:

a first current-directing device through which the first end of the solenoid is connected to the second pole of the current source for providing the measuring current through the solenoid when the first circuit breaker is open and the second circuit breaker is closed;

a second current-directing device through which the second end of the solenoid is connected to the second pole of the current source for preventing the formation of a closed current-carrying circuit which does not include the solenoid; and a third current-directing device arranged in series with the second current-directing device for leading energy of the solenoid that exceeds a predetermined voltage level back to the current source for preventing the second circuit-breaker from being supplied with excessively high voltage.

23. The solenoid-operated valve element of claim 22, wherein the first current-directing device is a diode, the second current-directing device is a back diode, and the third current-directing device is a zener diode.

24. The solenoid-operated valve element of claim 17, wherein the current measuring unit is connected at a measuring point between the second circuit breaker and the second pole of the current source for measuring the measuring current.

25. The solenoid-operated valve element of claim 24, further comprising a measuring resistor at the measuring point for measuring the current through the solenoid for detecting when the valve element reaches one of the end positions.

26. The solenoid-operated valve element of claim 17, wherein the valve element forms part of a valve for controlling fuel injection under high pressure in a directly injected diesel engine.

* * * * *